United States Patent [19]

Dahlby

[11] Patent Number: 4,854,454

[45] Date of Patent: Aug. 8, 1989

[54] APPARATUS AND METHOD FOR SEGREGATING PARTS

[75] Inventor: Larry C. Dahlby, Racine County, Wis.

[73] Assignee: S. C. Johnson & Son, Inc., Racine, Wis.

[21] Appl. No.: 163,914

[22] Filed: Mar. 3, 1988

Related U.S. Application Data

[63] Continuation-in-part of Ser. No. 13,085, Feb. 10, 1987, Pat. No. 4,752,007, which is a continuation-in-part of Ser. No. 821,661, Jan. 23, 1986, Pat. No. 4,676,380.

[51] Int. Cl.[4] ..... B07C 5/04

[52] U.S. Cl. ..... 209/616; 209/628

[58] Field of Search ..... 209/606, 607, 615, 616, 209/625, 628, 667, 671; 425/215–217, DIG. 51

[56] References Cited

U.S. PATENT DOCUMENTS

| | | | |
|---|---|---|---|
| 781,616 | 1/1905 | Owens et al. | 209/607 |
| 1,012,046 | 12/1911 | Anderson | 209/616 |
| 2,114,263 | 1/1938 | Heaslet | 209/616 |
| 2,710,097 | 6/1955 | Bolles | 209/12 |
| 3,047,149 | 7/1962 | DeKonig | 209/645 |
| 3,651,938 | 8/1972 | Suellentrop, Jr. et al. | 209/663 |
| 3,661,256 | 5/1972 | Hain | 209/645 |
| 3,663,142 | 12/1972 | Cafarelli | 425/217 |
| 3,982,632 | 9/1976 | DeLeon et al. | 209/616 |
| 4,224,350 | 9/1980 | Merck | 209/663 |
| 4,232,506 | 11/1980 | Studer | 209/616 |
| 4,676,380 | 6/1987 | Dahlby | 209/616 |
| 4,752,009 | 6/1988 | Dahlby | 209/616 |

FOREIGN PATENT DOCUMENTS 679042 1/1964 Canada .

*Primary Examiner*—Robert B. Reeves
*Assistant Examiner*—Donald T. Hajec

[57] ABSTRACT

The present invention is an apparatus for segregating desired articles of predetermined dimensions from a jumbled flow of such articles and unwanted pieces longer than the predetermined dimensions. The apparatus includes structure, tilted relative to the horizontal, that restricts the jumbled flow to a fixed-flow space whereby the jumbled flow is caused to flow along a flow path. The apparatus comprises a three-dimensional array of rotatable pickup fingers substantially filling the fixed-flow space and extending therebeyond. The apparatus includes a biasing element that co-acts with the rotatable pickup fingers to retain an unwanted piece removed from the jumbled flow by the pickup fingers. The apparatus further includes a suitable drive mechanism for continuously moving successive distal portions of the rotatable finger array out of and into the fixed-flow space, for bringing the unwanted pieces into biasing engagement with the biasing element, and for causing the thus-engaged unwanted pieces to be removed from the fixed-flow space.

3 Claims, 4 Drawing Sheets

APPARATUS AND METHOD FOR SEGREGATING PARTS

Reference to Related Applications

This application is a continuation-in-part of patent application Ser. No. 13,085 (filed Feb. 10, 1987) now U.S. Pat. No. 4,752,009 which in turn is a continuation-in-part of patent application Ser. No. 821,661, now U.S. Pat. No. 4,676,380, filed Jan. 23, 1986, the benefit of which is claimed for purposes of priority pursuant to 35 U.S.C. § 120.

TECHNICAL FIELD OF THE INVENTION

The present invention is directed to an apparatus and a method for the segregation of desired parts or articles from unwanted pieces. More particularly, the illustrated present invention is directed to an apparatus for segregation of formed parts of fixed dimensions from scrap pieces. Still more particularly, the present invention is directed to an apparatus and a method for segregating molded production parts from elongated runners which are a by-product of the parts-molding process.

BACKGROUND OF THE INVENTION

In plastic parts-molding operations, there is a need for sorting the output of the plastic molding machine into at least two separate groups—the first group being the desired plastic molded parts, and the other group being the molding-process plastic by-products (such as those herein referred to as elongated "runners") which are typically recycled for ultimate use as the desired plastic molded parts.

In typical operation, a molded parts-and-runner product emerges from the molding machine, which automatically cycles in a predetermined manner, wherein some of the desired molded parts are caused to be separated from the elongated runners. Typically, a jumbled mixture—of separated, randomly-oriented, desired molded parts and elongated runners—is moved from the molding machine via conveying apparatus for sorting (i.e., for separation into the two groups mentioned immediately above).

The process of sorting the output of molding machines of this type, in the distant past, was almost always performed by hand. Recently, however, certain devices have been provided, and improvements in methods have been made, to eliminate at least some of the need for manual sorting.

Certain devices and methods for segregation of desirable material from undesirable or unacceptable material are disclosed, for example, in U.S. Pat. Nos. 3,651,938; 3,982,632; 4,264,012; 4,451,030; and 4,484,684.

U.S. Pat. Nos. 3,651,938 (to Suellentrop, Jr., et al.) and 3,982,632 (to DeLeon et al.) each discloses a conveyer belt and a cylinder spaced laterally therefrom.

U.S. Pat. No. 4,264,012 (to Paradis) discloses a pair of spaced-apart baffles, and an axially-rotatable coil sandwiched therebetween.

U.S. Pat. No. 4,454,030 (to Young) discloses a conveyer belt that is fed by a screw-equipped conveyer.

U.S. Pat. No. 4,484,684 (to Tetreault) discloses an apparatus comprising a conveyer, a parts separator that is fed by the conveyer, an auger-comminuting device, and a chute. The auger-comminuting device and the chute are spaced from each other and from the parts separator which feeds them both.

Experience has shown that conventional devices, such as those briefly mentioned immediately above, possess certain deficiencies and accordingly present certain problems. For example, some prior-art devices have shown themselves to be less than thorough in their segregation of parts from runners.

In particular, it has been observed, when utilizing such conventional devices or apparatus, that runners (i.e. the undesirable by-products) too frequently fall between members or components that are purportedly intended or designed to catch or hold such runners, with the result being that an unacceptable percentage of the runners tends to be carried along with the separated, desired parts, which is of course undesirable. Such a result may necessitate subsequent manual separation (as was briefly mentioned above), or may result in the jamming of certain downstream equipment that is utilized, for example, to incorporate the desired part into a final product.

In modern factories that produce plastic molded parts, or that use such plastic parts in subsequent assembly, there is a need for an improved segregating apparatus which substantially eliminates or at least tends to minimize the failure of conventional parts-sorting equipment, for acceptably automatically sorting the desired parts from the scrap or by-product parts or pieces.

SUMMARY OF THE INVENTION

The present invention is broadly directed to an apparatus and to a method for segregating desired parts or articles of predetermined dimension from unwanted pieces having at least one dimension that is greater than the predetermined dimension. In particular, the illustrated embodiment of my present invention is directed to an apparatus for segregating desired molded-plastic parts of predetermined dimension from a jumbled flow of such parts and molded plastic by-product runners. The illustrated apparatus includes structure that defines a path for restricting the jumbled flow to a fixed-flow space along a preselected flow length (i.e., in a preselected flow direction).

The illustrated apparatus comprises a three-dimensional array of rotatable pickup fingers substantially filling the fixed-flow space and extending therebeyond. The apparatus includes a suitable drive mechanism for continuously moving successive portions of the rotatable pickup-finger array out of and into the fixed-flow space. The rotatable fingers are spaced apart by distances greater than the predetermined dimensions of the desired parts of articles, but less than the longest dimension of the unwanted pieces (i.e., the runners), for capturing the runners while allowing the desired parts to pass through the pick-up finger array.

The apparatus further optionally comprises at least one stationary finger so positioned within the rotatable three-dimensional pickup-finger array as to cause the desired parts to become separated from the by-product runners. In one illustrated embodiment of my invention, there is shown a plurality of such stationary fingers so positioned as to intermesh with the rotatable three-dimensional pickup-finger array, for such a purpose.

There is also shown, in accordance with the principles of my present invention, yet another embodiment of such a stationary finger. Such stationary finger is resiliednt, and is biased against certain structure of my apparatus. Further, such stationary finger on retaining means, because of its resiliency, is able to co-act with some of the rotatable pickup fingers in a manner such that the resilient stationary fingers biases at least one unwanted piece to retain it against a portion of the structure (defining the flow path) while such rotatable fingers cause the unwanted piece (or pieces) to be separated from the desired parts or articles and to be moved along a direction that is substantially transverse to the preselected flow direction.

The apparatus still further includes additional structure so located and configured as to not only remove the runners from the rotating fingers during movement of the three-dimensional rotating-finger array but also to allow the thus-removed runners to be conveyed under the influence of gravity away from the apparatus.

BRIEF DESCRIPTION OF THE DRAWINGS

Throughout the drawings, like reference numerals refer to like parts.

DETAILED DESCRIPTION OF PREFERRED EMBODIMENTS

Figure 5:
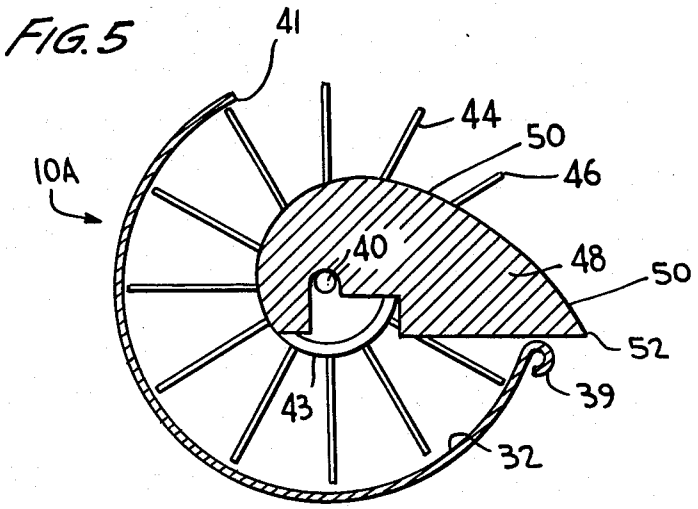
FIG. 5 is a projected, sectional view, taken approximately from the plane 5—5 in FIG. 3.
Figure 4:
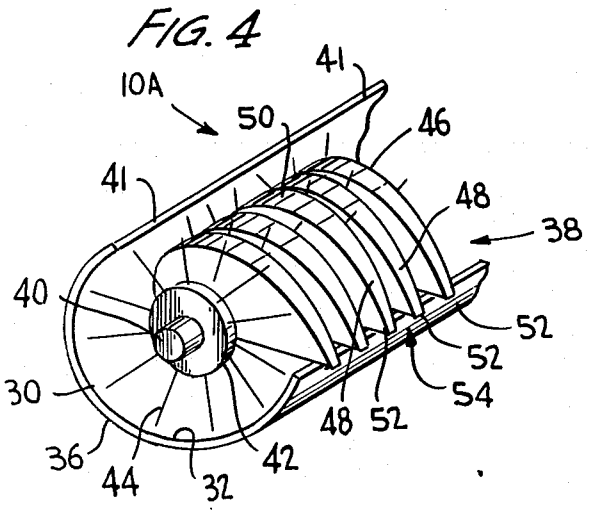
FIG. 4 is a partially-fragmented perspective view, also taken from the downstream end of the apparatus shown in FIGS. 2 and 3 but on a reduced scale relative thereto.

While the present invention is susceptible to embodiment in various forms, there is shown in the drawings and hereinafter described in detail a number of presently preferred embodiments of my invention, with the understanding that the present disclosure is to be considered as an exemplification of my invention, without limitation to the numerous specific embodiments illustrated herein.

The figures illustrate or present a segregator device or apparatus, in accordance with this invention, for separating parts or articles of predetermined dimension from a jumbled flow of such parts (or articles) and undesired pieces having at least one dimension that is greater than the predetermined dimension. The parts-segregator device or apparatus 10 (FIG. 1) is particularly useful in separating desired molded plastic parts from a jumbled flow of such parts, which jumbled flow includes not only the desired plastic parts but also certain elongated plastic runners to which the desired plastic parts were previously joined (i.e., when formed in the molding process).

Figure 1:
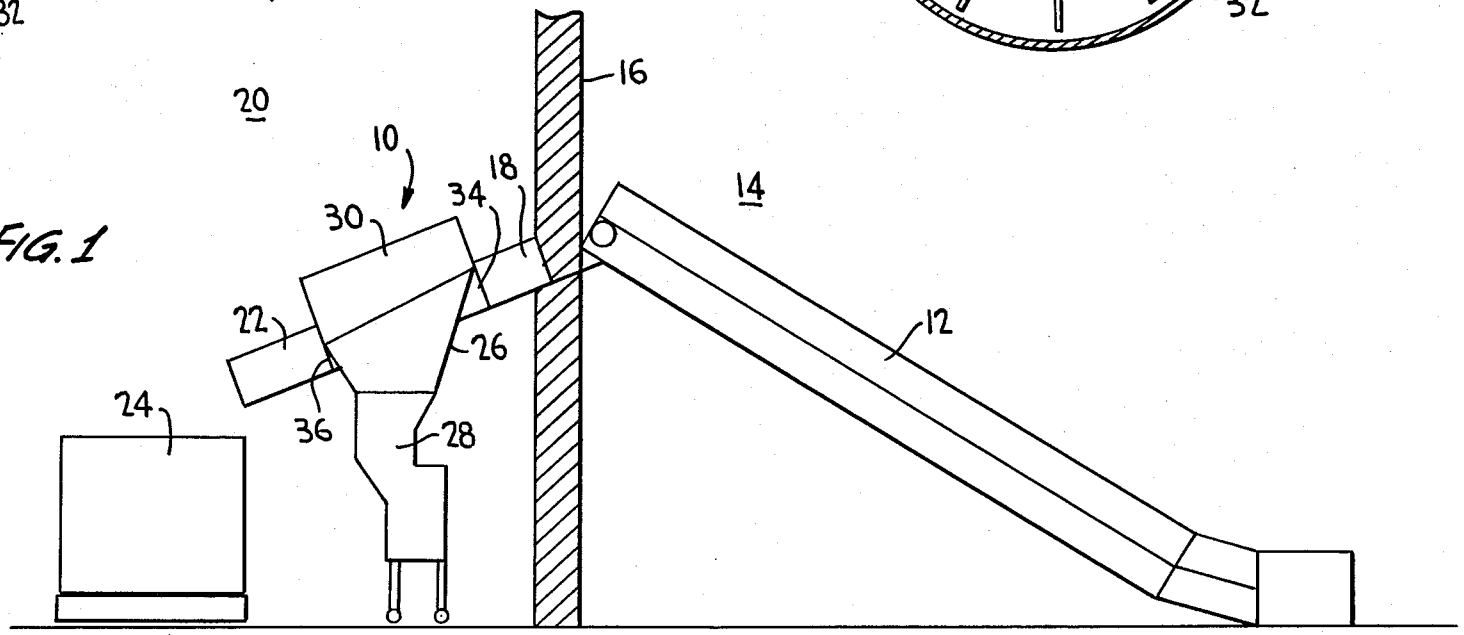
FIG. 1 is a schematic side elevation, illustrating one preferred use of the apparatus of my present invention in combination with a conventional plastic-molding process.

FIG. 1 accordingly presents the typical, preferred location and orientation of segregator device or apparatus 10 as it would be placed in a modern, plastic-parts production facility. An upwardly-directed, inclined conveyer 12 carries the jumbled plastic parts and elongated runners from molding equipment (not shown) in molding room 14 to an opening (also not shown) through wall 16, through which opening the desired plastic parts and elongated runners are dropped by operation of conveyer 12. Thereafter, the desired plastic parts and elongated runners are fed into a so-called "lead" chute 18 (which is in a sorting and storage room 20). Lead chute 18 guides the jumbled flow of molded parts and elongated runners, under the influence of gravity, into my segregator apparatus 10.

Briefly describing passage of the desired parts and unwanted pieces through the invention (FIG. 1), the present apparatus 10 segregates the desired, plastic-molded parts from the undesired, elongated runners (in a manner which will be described in greater detail hereinbelow). The desired molded parts slide through segregator apparatus 10, under the influence of gravity, and pass downwardly through exit chute 22 and from there into storage container 24. The undesired, elongated runners are lifted out of the flow of desired parts by the co-action of the several component parts (and structure) of the segregator apparatus 10. From segregator apparatus 10, the runners are caused to move—by operaton of the segregator apparatus 10—laterally into a side chute 26. The runners pass through the side chute 26, under the influence of gravity, and upon exiting side chute 26, drop into a grinder 28 which grinds the runners in preparation for subsequent re-use (e.g. for recycling the runners in the above-mentioned molded plastic parts-processing operation), as mentioned above.

Figure 2:
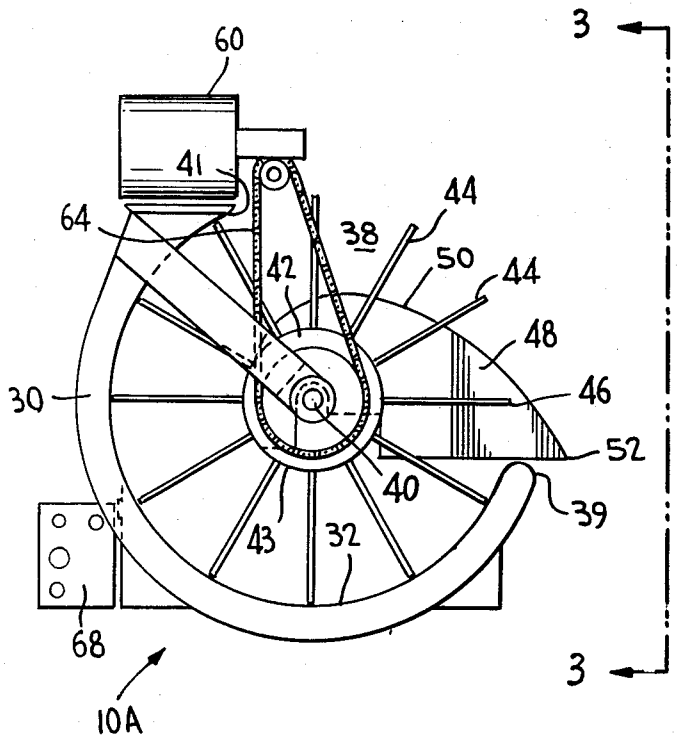
FIG. 2 is a "projected" or frontal view of one embodiment of my segregating apparatus (in accordance with the principles of my present invention), taken from the downstream end of the apparatus, such view being presented on an enlarged scale relative to FIG. 1.

A first embodiment of the present segregator apparatus 10A is more particularly described as follows. The segregator apparatus 10A includes a main chute 30 having a cylindrical inner surface 32 (FIG. 2). Main chute 30 has a lead end 34 (FIGS. 1 and 3) into which the molded-plastic parts and elongated runners flow. Main chute 30 also has an exit end 36 (FIGS. 1 and 3) from which the plastic parts alone exit the present parts-segregator apparatus or device.

Main chute 30 is preferably tilted relative to the horizontal, as shown in FIG. 1, so that gravity can be used to cause the jumbled flow of molded, desired plastic parts to pass through the main chute 30 of the segregator apparatus and into storage container or box 24. The segregator apparatus, in particular, is specifically designed to segregate the desired parts (of predetermined dimension) from the jumbled flow of such parts and runners, wherein the runners have at least one dimension that is greater than the desired parts dimension. To assist in such gravity flow, the cylindrical inner surface 32 of the first embodiment of the segregator apparatus 10A (i.e., shown in FIGS. 2–5) is preferably quite smooth. While the amount or degree of tilt should be sufficient for reliable flow through main chute 30, the amount or degree of tilt should not be too steep relative to the horizontal, because too great a tilt can slightly increase the chance of unintended passage of a runner all the way through chute 30, which is undesirable. A tilt of about 20° from the horizontal has been found to be acceptable in most instances.

Main chute 30 has an opening 38 (FIGS. 2 and 4) along its upper margin, and along a portion of one side thereof, which opening 38 is used for removal of the elongated runners after they are separated from the desired molded parts. Opening 38 extends from lateral edge 39 (of main chute 30) to upper edge 41 (FIG. 2), both of which edges 39 and 41 extend substantially parallel to shaft 40 (FIGS. 2–5) for the full length of main chute 30.

Figure 3:
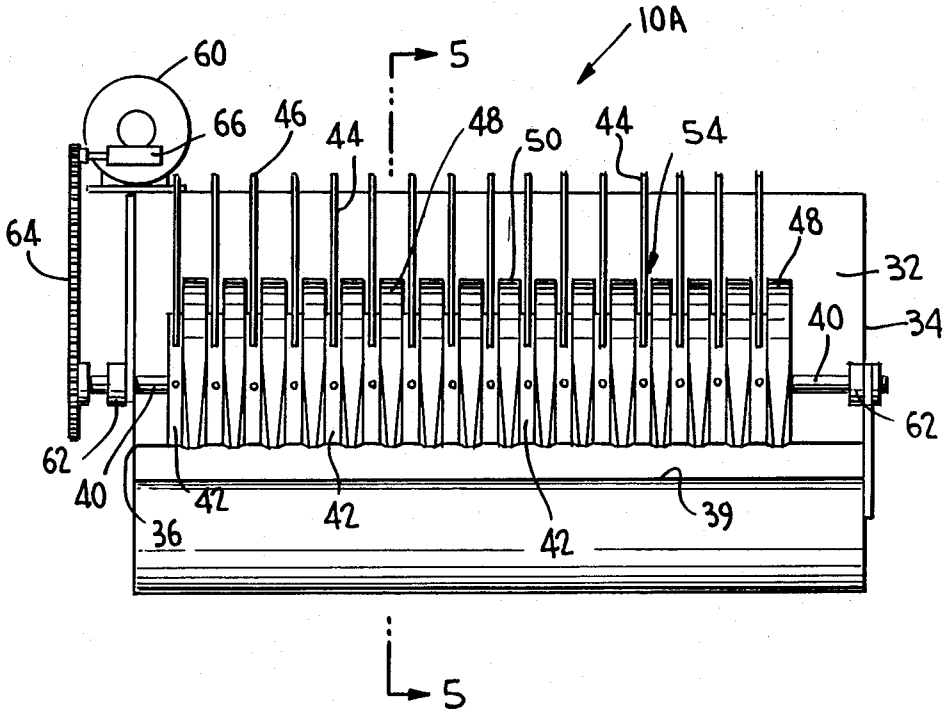
FIG. 3 is a side view taken from the plane 3—3 in FIG. 2.

Shaft 40, supported by bearing means 62 (FIG. 3), is located within the space defined by main chute 30, and is substantially concentric with respect to cylindrical inner surface 32 (FIG. 2). Shaft 40, moreover, extends substantially along the full length of main chute 30 (FIG. 3). Shaft 40 is caused to rotate in the bearing means 62 by operation of a suitable drive means such as the conventional drive motor 60. Drive motor 60, in turn, is operatively connected to shaft 40 by a suitable gear means such as the conventional gear box 66 and chain-drive means 64 (all shown in FIG. 3).

Removably fixed to shaft 40, at axial positions that are spaced preferably substantially equally along shaft 40, are a plurality of hubs 42 (FIGS. 2 and 3) that rotate along with shaft 40. Each of the hubs 42 has a circumferential surface 43 (FIG. 2); and a plurality of rod-liek fingers 44, of suitable length and resiliency, are removably secured to each such hub 42 along the circumferential surface 43 thereof (FIGS. 2 and 3). On each hub 42, moreover, the fingers 44 are preferably equally spaced along the circumferential surface 43 (FIG. 2). Furthermore, the fingers 44 preferably all have the same length, and all preferably extend along radii centered on their respective hubs 42 and on shaft 40.

The length of the rotating fingers 44 preferably is chosen such that the distal ends 46 thereof are spaced closely adjacent to the inner surface 32 of main chute 30 (FIGS. 2 and 5). Because the rotating fingers 44 are preferably resilient, and therefore somewhat stiff yet relatively flexible, the length of the fingers 44 can be such that the distal ends 46 may even be in contact with the inner surface 32 during at least a portion of the rotation at the fingers 44 relative to the inner surface 32. In certain other situations, however, it can be appreciated that it might be desirable to so design certain resilient rotatable fingers such that the distal end portions overlie the cylindrical inner surface 32 of main chute 30.

The rotatable fingers 44, together with the shaft 40 and the hubs 42, form a three-dimensional array of rotating pickup-finger means, wherein the rotatable fingers 44 are so positioned as to substantially fill the confined space, in main chute 30, that is defined by the cylindrical inner surface 32. The three-dimensional pickup-finger array is caused to rotate in bearing means 62 by drive motor 60, with the distal ends 46 (FIGS. 2 and 3) of the rotatable fingers 44 moving repeatedly into and out of the confined space (within main chute 30). Such rotation of the fingers 44 relative to the main chute 30 can be in a clockwise direction (i.e., as viewed from FIGS. 2 and 5) or in a counterclockwise direction (not shown), whichever is desired. When operating in the illustrated clockwise direction, the distal ends 46 of the rotating fingers 44 (leaving the confined space in main chute 30) first pass upper edge 41, and thereafter pass through stripper elements 48 (described in greater detail below), and then finally pass lateral edge 39 (FIG. 5) before once again entering the confined space in main chute 30.

To accomplish parts separation, in accordance with the principles of the present invention, the rotational speed of the fingers 44 will depend, to some extent, upon the total number of fingers 44, the diameter and length of the main chute 30, the circumferential spacing of the fingers 44 about individual hubs 42, and the axial spacing of the fingers 44 along the length of shaft 40, all relative to the predetermined dimensions of the desired parts and by-product runners. For example, when the main chute 30 is about 2 feet in diameter, the rotational speed of the fingers 44 is generally about 1 to about 4 revolutions per minute (RPMs).

The rotating fingers 44 of the three-dimensional array are spaced apart, at their distal ends 46, by distances that are greater than the dimensions of the desired plastic parts that are to be separated from the jumbled flow (of plastic parts and elongated runners). Such spacing of rotating fingers 44, however, is preferably less than the length of the longest dimension of the elongated runners. In the parts-molding operation (briefly mentioned and discussed hereinabove), parts-and-runners molds can usually be readily designed to cause desired molded-plastic parts and by-product runners to have suitable dimensions so as to enable the present segregator apparatus to achieve the parts-separation result discussed herein.

In a preferred arrangement of rotating fingers 44 (FIG. 4), alternating hubs 42 have the respective rotating fingers 44 mounted thereon in a manner such that the rotating fingers 44 on any one hub 42 are radially aligned so as to be disposed between the fingers 44 on its nearest hub neighbors. This so-called "offset" arrangement of the fingers 44 has been observed to substantially eliminate any unintended passage of elongated runners through main chute 30, for many of the different-sized runners currently being segregated by the present segregator apparatus illustrated in FIGS. 2–5.

By virtue of such spacing of rotating fingers 44, the desired molded-plastic parts that slide through main chute 30, while they might engage the rotating fingers 44 during such movement, pass through the array of fingers 44, under the influence of gravity, and exit main chute 30 at its exit end 36. In contradistinction, the elongated runners in main chute 30 are captured, by the rotating fingers 44, and thereafter are moved (by the rotating fingers 44), along the cylindrical inner surface 32, in a direction that is generally transverse to the direction of movement of the desired molded-plastic parts, and finally, are lifted by the rotating fingers 44, for lateral removal from main chute 30, again utilizing the force of gravity.

Such removal of the runners is accomplished by the interaction of the rotating array of pickup fingers 44 with an aligned array of stripper elements 48 (FIGS. 2 and 3), which are sandwiched between (i.e., disposed so as to intermesh with) the several pluralities of rotatable fingers 44, as shown in FIG. 3. Slots or lateral spaces 54 (FIG. 4), which are perpendicular to shaft 40 and aligned with the hubs 42, are defined between adjacent pairs of stripper elements 48. The number, positioning and orientation of the several slots 54 is such that all of the rotating fingers 44 of each hub 42, are caused by operation of drive motor 60, operatively connected (as above described) to shaft 40, to turn or rotate within a corresponding one of the slots 54, as shown in FIG. 3.

Furthermore, as shown in FIG. 5, each stripper element 48 is supported at one end portion thereof by shaft 40 and at the opposite end portion thereof by lateral edge 39 (of main chute lateral opening 38). The stripper elements 48 are preferably equally spaced longitudinally along shaft 40, intermeshing with hubs 42, as shown in FIG. 3.

The stripper elements 48, still further, preferably have upwardly-facing arcuate surfaces 50 (FIGS. 3–5) of convex curvature, which surfaces are in alignment so that when viewed along the projected view (FIGS. 2 and 5), the parts-stripper upper surfaces 50, taken together, are seen to form a runner reception surface onto which the elongated runners are deposited by the rotating action of the three-dimensional array of pickup fingers 44 and from which such runner reception surface the runners slide laterally and downwardly into side chute 26 and ultimately into grinder 28 (FIG. 1).

The above-described runner-reception surface that is formed by the upper surfaces 50 of stripper elements 48 extends from a position within the three-dimensional pickup-finger array to a lateral position outside such array, as shown in FIG. 5. Such a runner-reception surface has a terminal edge 52 (as indicated in FIGS. 2 and 5) which is radially outwardly spaced from the terminal boundary of the array of rotating fingers 44 relative to shaft 40.

The above-described runner-reception surface (that is formed by the upper surfaces 50) and the arcs that are scribed by the movement of the distal ends 46 of the rotating fingers 44 intersect at a predetermined location on the downward slope of the runner reception surface (FIGS. 2 and 5) that is disposed generally downwardly so that the runners can slide, on the surfaces 50 and under the influence of gravity, as described above. In particular, it is at this point of intersection that the elongated runners, which have been removed from the jumbled flow of by-product runners and plastic parts, are released from the three-dimensional array of rotating fingers 44, and thereby caused by the downward slope of the runner reception surface to slide into side chute 26 (FIG. 1). The degree to which the upper surface 50 tilts downwardly, from this point of intersection, is not critical but will depend, to a large extent, upon the weight of an individual runner and the coefficient of friciton of the runner relative to the upper surface 50.

The rotating fingers 44 are preferably made from a suitably-stiff, resilient material such as nylon rods (that are generally circular in cross section), or are preferably made of other commercially-availabe relatively-rigid yet somewhat flexible, suitably-resilient material. The ability of the rotating fingers 44 to flex, to some extent, tends to prevent substantially any jams (or damage to the segregator apparatus or device) from occurring, as might be caused by unexpected conditions when utilizing conventional separation equipment.

It has also been observed, in a parts-molding operation which generates no by-product runners, that operation of the parts-segregator device disclosed herein, particularly operation of the rotatable pickup-finger array discussed hereinabove, has the tendency of agitating the desired parts that are in main chute 30 and causes the desired parts to tumble and thereby freely flow through main 30 (by this "agitating" effect), virtually eliminating plug-ups in main chute 30, which is of course desirable. This "agitating" effect does away with the typical conventional requirement that requires removing a conventional parts-segregator apparatus from a conventional parts-separation system—much like the parts-separation system that is shown in FIG. 1—when utilizing a "parts" mold that generates no runners.

Variations, of course, can be made to the segregator apparatus or device 10A, described hereinabove, to adapt it for different segregating jobs. For example, changes in the sizes of the parts and the elongated runners might require changes in the arrangement and/or the spacing of the rotating fingers 44, which design changes would be obvious to those skilled in the art. Also, the speed of rotation of the rotating fingers 44 can be adjusted by varying the speed of the drive motor 60, utilizing a suitable speed-control means such as the conventional motor-control means 68, as is shown in FIG. 2.

Figure 6:
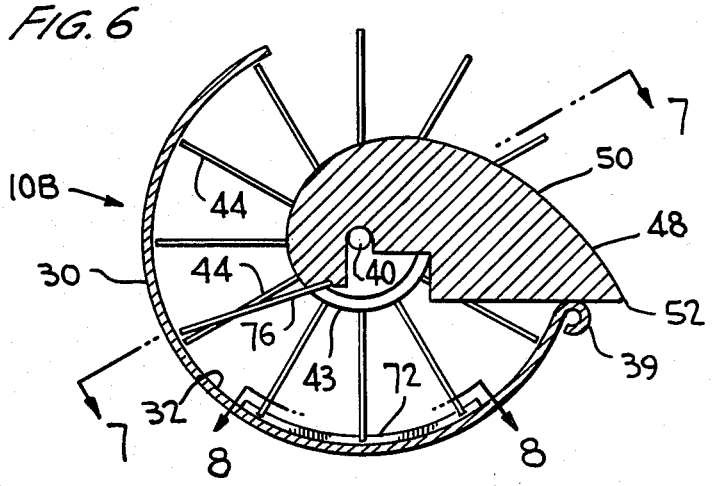
FIG. 6 is a projected, sectional view of yet another embodiment of my apparatus; in accordance with the principles of the present invention.
Figure 7:
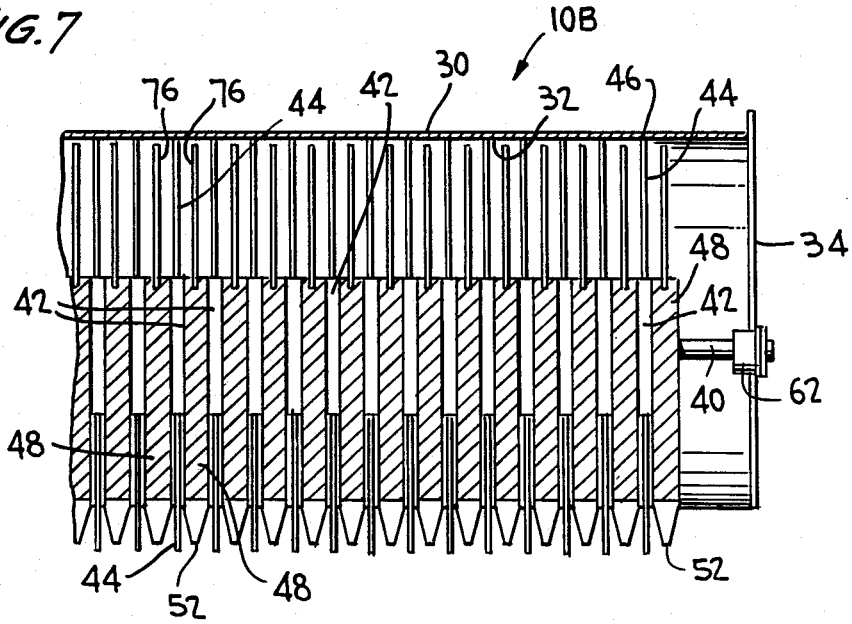
FIG. 7 is a partially-fragmented, plan view, taken approximately from the plane 7—7 in FIG. 6.
Figure 8:
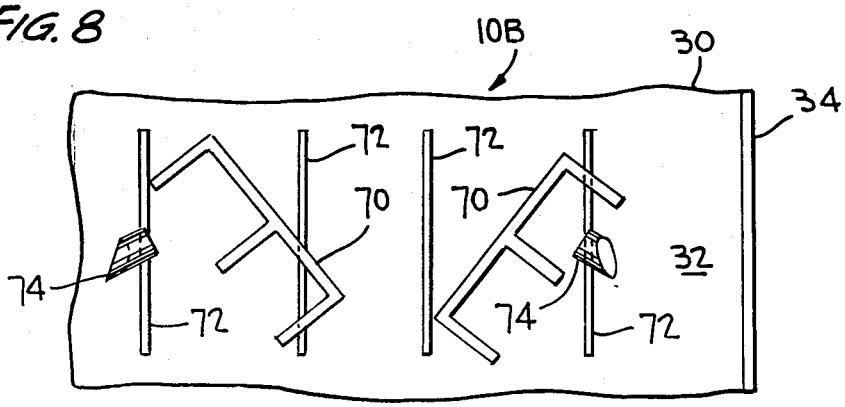
FIG. 8 is a partially-fragmented, plan view, taken approximately from the plane 8—8 in FIG. 6.

Referring now to FIGS. 6–8, additional preferred embodiments of the parts-segregator apparatus of the present invention will briefly be described.

In certain situations involving relatively rather thin, yet somewhat elongated, by-product runners 70 (FIG. 8) it is desirable to incorporate into the second embodiment of the segregator apparatus or device 10B a raised projection of suitable dimension, such as the longitudinally spaced-apart ribs 72 shown in FIGS. 6 and 8.

The ribs 72, preferably arcuate (FIG. 6) and configured to conform substantially to the curvature of the cylindrical inner surface 32 of main chute 30, typically possess a height dimension sufficient to substantially block a major portion of the by-product runners 70 from freely sliding axially across the cylindrical inner surface 32 of main chute 30 (FIG. 8) when tilted relative to the horizontal (as shown in FIG. 1), while allowing a substantial portion (i.e., virtually all) of the desired parts 74 to freely slide generally axially across inner surface 32 and into storage container 24 (FIG. 1) as described above. That is, the ribs 72 do not possess so great a height dimension as to block the above-described free-flow of the desired parts 74 longitudinally down the main chute 30, which result is desirable. (The desired parts 74 and by-product runners 70 are not shown in FIGS. 6 and 7, but only in FIG. 8, for reasons of clarity.)

Stating this another way, the molds (not shown) that are used to produce not only the desired parts 74 but also the by-product runners 70 are specifically designed—as is well-known in the art—so that the runner 70 is relatively thinner (at least in one dimension) than the desired parts 74. Thus the ribs 72, preferably removably affixed to the main chute inner surface 32, are suitably dimensioned (relative to the desired part and by-product runner dimensions) to achieve the result discussed above.

Yet, in certain other situations, it is desirable to incorporate into the present segregator apparatus or device at least one stationary finger 76. Preferably, the segregator apparatus includes a plurality of spaced-apart stationary fingers 76, wherein each finger 76, wherein each finger 76 of the plurality is removably affixed to a respective stripper element 48. Together, the plural stationary fingers 76 intermesh with the plural rotating fingers 44 (as is shown in FIG. 7), thereby providing a "combing" effect, for causing a substantial portion (i.e., virtually all) of the by-product runners 70 to separate from the desired parts 74. For example, in certain situations, the desired parts 74 can become entangled with the by-product runners 70; and the combing effect has been observed to separate thus-entangled parts from runners.

Or, in certain oher situations such as after the parts 74 and runners 70 have been separated, one such desired part 74 may have an opening through which an end portion of another such runner 70 is disposed; and this, at times, has been observed to cause the desired part 74 to be removed from the main chute 30 along with the runner 70 (through operation of the rotating fingers 44, as described above). That is, a part 74 having such an opening can occasionally be observed to be carried along with a runner (such as in the case where a desired part is impaled upon an end portion of a runner), with the result being that the runner together with the desired part (impaled thereon) are removed by operation of the pickup-finger array. In both types of situations, the location and positioning of the stationary fingers 76 relative to the rotating fingers 44 has been observed to positively cause separation of the desired part from the by-product runner.

The stationary fingers 76 are preferably rod-like, are preferably circular in cross section, have distal ends that are spaced preferably relatively closely to the cylindrical inner surface 32 of main chute 30 (as shown in FIG. 7), and are preferably made of the same resilient material as the rotating fingers 44. Moreover, the stationary fingers 76 preferably have a relatively smaller diameter than the rotating fingers 44 so that the stationary fingers 76 flex (before the rotating fingers 44) when opposed, for example, by rotational movement of the rotating fingers 44 about shaft 40.

In operation, this feature of the present invention not only enables the rotating and stationary fingers 44 and 76 to function cooperatively to cause the runners 70 and desired parts 74 to separate, as described above, but also enables the runners 70 to be urged by the rotating fingers 44 through the array of flexing stationary fingers 76, whereupon the rotating-finger array selectively removes the runners 70 from the above-defined confined space (in main chute 30) and thereafter deposits the runners 70 on the upwardly-facing surfaces 50 of the stripper elements 48, substantially in the manner described above.

Further, each stationary finger 76 is preferably removably press-fitted into a respective stripper element 48, and disposed generally downwardly and outwardly therefrom, as shown in FIGS. 6 and 7, respectively. While the stationary fingers 76 can be disposed radially outwardly on stripper element 48 relative to shaft 40, the preferred orientation of the stationary fingers 76 is skewed—i.e., away from a "true" radial disposition—in the direction of rotation of the rotating fingers 44 (which is clockwise, when viewed from the downstream end, as mentioned above) as is shown in FIG. 6.

Referring briefly to FIGS. 9, 10, 10A and 11, still other preferred embodiments of the parts-segregator apparatus of the present invention will now be discussed.

Figure 9:
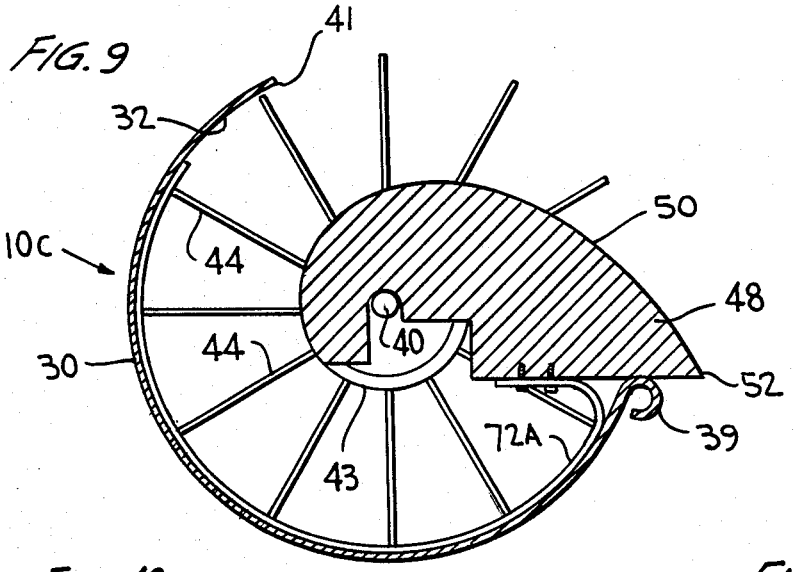
FIG. 9 is a projected, sectional view of still another embodiment of my apparatus, in accordance with the principles of my present invention.

In lieu of, or in addition to the above-mentioned rib 72, shown mounted in main chute 30 (FIG. 6), the parts-segregator apparatus 10C can include at least one elongated arcuate rib 72A removably affixed by conventional fastener means to stripper element 48, as is shown in FIG. 9. The elongated arcuate rib 72A, preferably made of spring steel, is fastened at one end to a suitable stripper element 48, and is thus caused to biasingly overlie the cylindrical inner surface 32 of main chute 30 transverse to the direction of flow of the desired parts. The distance from the free end of rib 72A to upper edge 41 of main chute 30 is a matter of design choice. Rib 72A possesses a height dimension sufficient to substantially block a major portion of the undesired pieces from freely sliding axially across the cylindrical inner surface 32 of main chute 30 when tilted relative to the horizontal (as shown in FIG. 1), while allowing a substantial portion (i.e., virtually all) of the desired parts or articles to freely slide generally axially across inner surface 32 and into storage container 24 (FIG. 1) as described above.

In operation, undersired pieces sliding longitudinally down the inclined (FIG. 1) inner surface 32 of main chute 30 have been observed to be stopped by the presence of rib 72A. The rotating fingers 44 then capture such stopped, undesired pieces and deposit them on the stripper elements 48, generally in the manner described above. For illustrated rib 72A, a spring steel rib having a $\frac{3}{8}$ inch width (i.e., in the longitudinal direction relative to the direction of parts-and-pieces flow) and a 0.035 inch thickness (i.e., in the radial direction relative to the curved surface 32 of main chute 30) has proven sufficient for such a purpose. Further, because each such stripper element 48 rests on shaft 40 and lateral edge 39 of main chute 30 (FIG. 9), relocation of the illustrated rib 72A from one longitudinal position to another, or removal of the illustrated rib 72A from the parts-segregator apparatus 10C of the present invention, can readily be achieved by substituting one stripper element 48 for another. Still further, several stripper elements 48 of the parts-segregator apparatus 10C can each have such an attached rib 72A, if desired.

Figure 10:
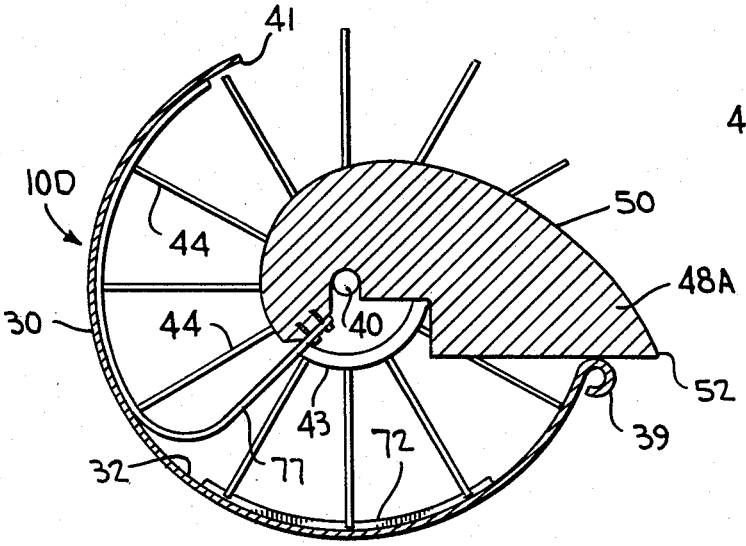
FIG. 10 is a projected, sectional view of yet another embodiment of my apparatus, further in accordance with the principles of my present invention.
Figure 10A:
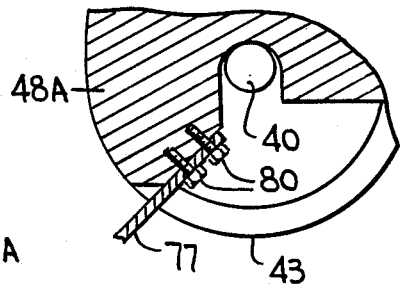
FIG. 10A is a partially fragmented sectional view, on an enlarged scale relative to FIG. 10, showng a detail presented in FIG. 10.

Moreover, an edge portion of stripper element 48A can readily be modified for the purpose of attaching an elongated, arcuate finger 77, as is shown in FIG. 10. Preferably, arcuate finger 77 is removably attached to stationary element 48A by suitable threaded fastener means such as illustrated bolts 80 (FIG. 10A).

Also, the parts-segregator apparatus 10D can include the arcuate finger 77, in addition to, or in lieu of the above-mentioned stationary fingers 76 (FIGS. 6 and 7), the latter situation being shown in FIG. 10. The elongated, arcuate finger 77, like stationary finger 76, is stationary relative to the revolving fingers 44.

If desired, the parts-segregator apparatus can include a plurality of modified stripper elements 48A, each such stripper element including a suitable resilient arcuate finger 77, so that the plurality of stationary arcuate fingers are able to co-act with the movable fingers 44 to provide the above-mentioned "combing" effect. Generally, however, the part-segregator apparatus 10D includes only one such arcuate finger 77.

The elongated, arcuate finger 77, preferably made of spring steel, is disposed generally radially at its fastened end portion. The remainder portion of the arcuate finger 77 is caused to biasingly overlie that portion of the cylindrical inner surface 32 of main chute 30 where an undesired piece is most likely to be urged by operation of the movable fingers 44. For example, because the movable fingers 44 (shown in FIG. 10) rotate clockwise, it is desirable to have the free end portion of arcuate finger 77 biasingly overlie the generally 8–11 o'clock positions, which is generally transverse to the direction of movement of the desired parts or articles along surface 32 of main chute 30. (The distance from the free end of arcuate stationary finger 77 to upper edge 41 of main chute 30 is, of course, a matter of design choice.)

Location of the arcuate finger 77 at a desired point along the length of shaft 40 will depend upon a number of considerations such as rotational speed of the movable fingers 44, overall shape and general dimensions of a desired part or article, whether a rib 72 or 72A is being utilized, and general shape of an undesired piece or runner.

Figure 11:
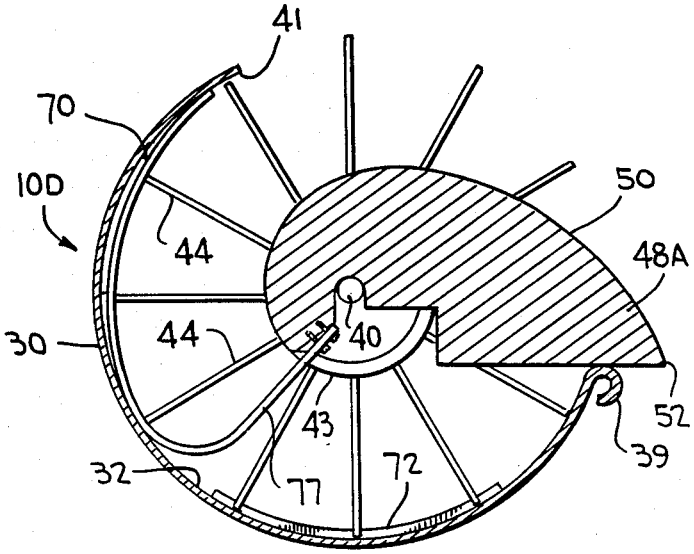
FIG. 11 is the projected, sectional view of that embodiment of my apparatus which is shown in FIG. 10, illustrating how a rotatable finger co-acts with the resilient stationary finger to "trap" an unwanted piece that is to be removed (from the jumbled flow of parts) by operation of my apparatus.

Arcuate finger 77 and adjacent rotating fingers 44 co-act as follows. In operation, movable fingers 44 stop the forward progress of undesired pieces along the downwardly sloping inner surface 32 of main chute 30. Rotation of the movable fingers 44 causes such stopped, undesired pieces to be moved in the direction of the resilient arcuate finger 77. Arcuate finger 77 is so located axially relative to shaft 40 as to be as close as possible to the mid-point of each thus-stopped undesired piece. (For example, elongated undesired pieces tend to orient themselves longitudinally in the general direction of shaft 40.) Further rotation of the movable fingers 44, relative to the thus-located arcuate finger 77, urges the undesired piece 70 between the arcuate finger 77 and inner surface 32 of main chute 30 (FIG. 11). By so locating resilient stationary finger 77, movable fingers 44 cause undesired pieces to be positively located (i.e. "trapped") between resilient stationary finger 77 and the inner surface 32 of main chute 30. Further rotation of fingers 44 moves the thus-trapped piece 70 (now "pinched" between the spring steel finger 77 and the main chute 30) to move in an arcuate manner, following the inner surface 32 of chute 30. As the piece 70 approaches the upper edge 41 of chute 30, such unwanted piece is drawn downwardly by gravity, becoming impaled on the rotating fingers 44. The still rotating fingers 44 then deposit the thus-removed undesired pieces onto the curved surfaces 50 of stripper element 48; and the undesired pieces are then deposited into side chute 26, in the manner described above. A spring steel finger 77 having a ¾ inch width (i.e., in the longitudinal direction relative to the direction of parts-and-pieces flow) and a 0.025 inch thickness (i.e., in the radial direction relative to the curved surface 32 of main chute 30) has proven sufficient for such a purpose.

What has been illustrated and described herein is a novel segregator apparatus. While the segregator apparatus of the present invention has been illustrated and described with reference to several preferred embodiments, the present invention is not limited thereto. On the contrary, alternatives, changes or modifications will become apparent to those skilled in the art upon reading the foregoing description. For example, the segregator apparatus of the present invention can be made utilizing materials and parts which are well-known to those skilled in the art; and, as to the component parts (of the invention) discussed hereinabove, appropriate choices would be apparent to those familiar with this patent specification. Accordingly, such alternatives, changes and modifications are to be considered as forming a part of the invention insofar as they fall within the spirit and scope of the appended claims.

I claim:

1. An apparatus for segregating articles of predetermined dimensions from a jumbled flow of such articles and unwanted pieces longer than said predetermined dimensions, comprising:

path means, including a chute having a cylindrical inside surface defining a lateral opening therethrough, for restricting the jumbled flow to a fixed flow space along a flow length, the cylindrical surface defining the fixed flow space, the fixed flow space being inclined for gravity flow therethrough;

a three-dimensional array of pickup fingers substantially filling the fixed flow space and extending therebeyond, distal end portions of said pickup fingers being spaced apart by distances greater than the predetermined dimensions of the articles, the distal end portions of the pickup fingers being so disposed in the chute as to contact both the articles and the unwanted pieces passing therethrough;

retaining means overlying a portion of the cylindrical surface and biased thereagainst;

means to continuously move successive distal portions of the pickup finger array out of and into the fixed flow space, for selectively picking up and removing the unwanted pieces from the cylindrical inside surface of the chute and thereby urging the unwanted pieces along and retaining them between the retaining means and the cylindrical surface; and stationary means so located along the flow length as to be disposed between the adjacent pickup fingers and extending from the fixed flow space laterally to a position adjacent thereto, for receiving the unwanted pieces from the pickup-finger array thereby stripping the unwanted pieces from said pickup fingers during pickup-finger array movement, the stationary stripping means extending through the cylindrical surface lateral opening.

2. The apparatus in accordance with claim 1 and further comprising rib means positioned in the chute transverse to the flow length and so dimensioned as to substantially block a major portion of the unwanted pieces from freely sliding along the flow length yet allowing a substantial portion of the articles to freely slide along the flow length and through the chute.

3. A method of segregating articles of predetermined dimensions from a jumbled flow of such articles and unwanted pieces longer than said dimensions, comprising:

directing said flow into a fixed flow space bounded by a cylindrical inside surface of a chute, the chute including retaining means overlying a portion of the cylindrical surface and biased thereagainst, the cylindrical inside surface defining a lateral opening through the chute, the cylindrical surface defining the fixed flow space, the fixed flow space being inclined for gravity flow therethrough;

rotating successive distal portions of a three-dimensional array of fingers relative to the retaining means and a stationary stripping means that extends through the chute lateral opening, the finger array substantially filling the fixed flow space, for selectively removing the unwanted pieces from the chute and thereby urging the unwanted pieces along and retaining them between the retaining means and the cylindrical surface of the chute, distal end portions of said fingers being spaced apart by more than the predetermined dimensions of the articles, the distal portions of the fingers being so disposed in the chute as to contact both the articles and the unwanted pieces passing therethrough; and further rotating the distal portions of the finger array relative to the retaining means and the stationary stripping means for positioning the unwanted pieces on the stationary stripping means, thereby stripping the unwanted pieces from the fingers after the fingers have been so rotated relative to the stripping means as to have the distal portions thereof disposed out of the fixed flow space and in the direction of the chute lateral opening.

* * * * *